US006015228A

United States Patent [19]

Muller et al.

[11] Patent Number: 6,015,228

[45] Date of Patent: Jan. 18, 2000

[54] DRY MATERIAL AND SLURRY PROCESSOR

[76] Inventors: Ernst R. Muller; Michael R. Muller; Steve J. Cencich, all of Box 1653, Grand Rapids, Mich. 49501

[21] Appl. No.: 08/982,686

[22] Filed: Dec. 2, 1997

Related U.S. Application Data

[63] Continuation-in-part of application No. 08/978,079, Nov. 11, 1997

[60] Provisional application No. 60/031,456, Nov. 26, 1996.

[51] Int. Cl.[7] ..... B01F 15/02; B01F 9/10

[52] U.S. Cl. ..... 366/186; 366/234; 366/314; 241/74; 198/550.6; 209/304

[58] Field of Search ..... 366/184, 186, 366/234, 314, 241, 155.1, 154.1; 198/550.6, 550.1; 241/73, 74; 209/304, 305, 257, 245

[56] References Cited

U.S. PATENT DOCUMENTS

| | | | |
|---|---|---|---|
| 1,108,944 | 9/1914 | Tannenbaum | 198/550.6 |
| 1,393,949 | 10/1921 | Lowe | 241/74 |
| 1,454,031 | 5/1923 | Babcock | 241/74 |
| 1,837,807 | 12/1931 | Bruffee | 209/257 |
| 2,240,213 | 4/1941 | Fromm | 366/184 |
| 2,329,910 | 9/1943 | Johnson | 241/74 |
| 2,822,846 | 2/1958 | Ward | 241/74 |
| 2,886,254 | 5/1959 | Rohlinger et al. | 241/74 |
| 3,164,329 | 1/1965 | Wandel | 241/74 |
| 3,191,873 | 6/1965 | Schmidt | 241/74 |
| 3,241,657 | 3/1966 | Buschbom | 198/550.6 |
| 3,386,670 | 6/1968 | Heger | 241/74 |
| 5,161,341 | 11/1992 | Gilles | 366/186 |
| 5,289,763 | 3/1994 | Le Rouzic et al. | 366/314 |
| 5,405,094 | 4/1995 | Poser et al. | 241/74 |
| 5,419,633 | 5/1995 | Lorenzetti | 366/314 |
| 5,607,062 | 3/1997 | Poser et al. | 241/74 |

FOREIGN PATENT DOCUMENTS 1230985 5/1971 United Kingdom .

*Primary Examiner*—Tony G. Soohoo
*Attorney, Agent, or Firm*—Waters and Morse, P.C.

[57] ABSTRACT

A material processor having an enclosure with an ingress to receive material into the enclosure, and a discharge to remove homogenous material from the enclosure. A spindle is located in the enclosure, has a longitudinal spindle axis, and is rotatable about the spindle axis. A drive is operatively connected with the spindle to rotate the spindle about the spindle axis. A centrifugal sieve is located in the enclosure and coupled with the spindle. The ingress feeds material into the sieve. A conveyor is connected with the discharge to transfer mixed material from the enclosure. The conveyor further has a generally cylindrical tube with a tube diameter, two opposing ends, and a tube axis extending through the ends. A helical blade extends along the tube axis between the two ends and is rotated about the tube axis. More particularly, the helical blade may have a series of blade tips that are spaced along the tube axis. Adjacent blade tips may be spaced apart by a distance that is less than or equal to about one half the tube diameter.

4 Claims, 14 Drawing Sheets

DRY MATERIAL AND SLURRY PROCESSOR

CROSS-REFERENCES TO RELATED APPLICATIONS

This is a continuation in part application of co-pending U.S. application Ser. No. 08/978,079, filed on Nov. 11, 1997 which is a continuation in part application of co-pending U.S. patent application Ser. No. 60/031,456, entitled DRY MATERIAL AND SLURRY PROCESSOR and filed on Nov. 26, 1996, by Muller et al., the disclosure of which is incorporated here by reference.

STATEMENT REGARDING FEDERALLY SPONSORED RESEARCH OR DEVELOPMENT

Not Applicable.

BACKGROUND OF THE INVENTION

The invention relates to material processing and more particularly to the processing of dry and granular materials, liquids, and slurries to obtain a homogenous compound, whether dry or liquid.

In many commercial settings, including commercial baking or chemical mixing processes, for example, materials commonly need to be sifted or mixed. Traditionally, this process has been accomplished with paddle-wheel type mixers or blenders. The traditional mixing machine comprises a barrel-like enclosure that is laid horizontally with a paddle shaft extending horizontally through the enclosure. An array of mixing paddles extend generally radially outward from the shaft, in the enclosure, and rotate with the shaft to mix selected ingredients that are placed in the enclosure. These traditional mixing machines are, however, quite slow. They also fail to sift the ingredients, thus requiring an additional processing step with additional equipment to break up clumps of material, or sift the mixture. Further, it is inherent in the traditional paddle type mixer that the mixing process occurs on a large scale. That is to say that the batch of mixture may have the desired ratios of the selected ingredients, but any given, small sample of the mixture may not. The resulting mixture may not be homogenous.

One may, then, realize a need for equipment that provides high speed mixing and sifting of ingredients, either wet or dry, to quickly provide a homogenous blend.

BRIEF SUMMARY OF THE INVENTION

Accordingly, the present invention provides a material processor having an enclosure with an ingress to receive material into the enclosure, and a discharge to remove material from the enclosure. A spindle is located in the enclosure, has a longitudinal spindle axis, and is rotatable about the spindle axis. A drive is operatively connected with the spindle to rotate the spindle about the spindle axis. A centrifugal sieve is located in the enclosure and coupled with the spindle. The ingress feeds material into the sieve. A conveyor is connected with the discharge to transfer material from the enclosure. The conveyor further has a generally cylindrical tube with a tube diameter, two opposing ends, and a tube axis extending through the ends. A helical blade extends along the tube axis between the two ends and is rotated about the tube axis.

More particularly, the helical blade may have a series of blade tips that are spaced along the tube axis. Adjacent blade tips may be spaced apart by a distance that is less than or equal to about one half the tube diameter. Further, the helical blade is rotated at high speed, more specifically, between about 600 to about 1500 rpm. In another aspect of the invention, a volumetric ratio of material conveyed in the conveyor as compared to the internal volume of the conveyor is between about ten to about twenty percent.

Additionally, the tube may include first and second tube sections, or more, that are coupled together with a clamp ring. The first section may have a male end with a male flange, while the second section may have a female end with a corresponding female flange. The male and female ends and flanges abut one another to define a generally truncated V-shaped ridge that extends outward from the tube with opposing, inclined surfaces. The clamp ring overlays and presses inward upon the inclined surfaces to press the male and female flanges and ends together.

These and other features, objects, and benefits of the invention will be recognized by one having ordinary skill in the art and by those who practice the invention, from the specification, the claims, and the drawing figures.

DETAILED DESCRIPTION OF THE INVENTION

Figure 1:
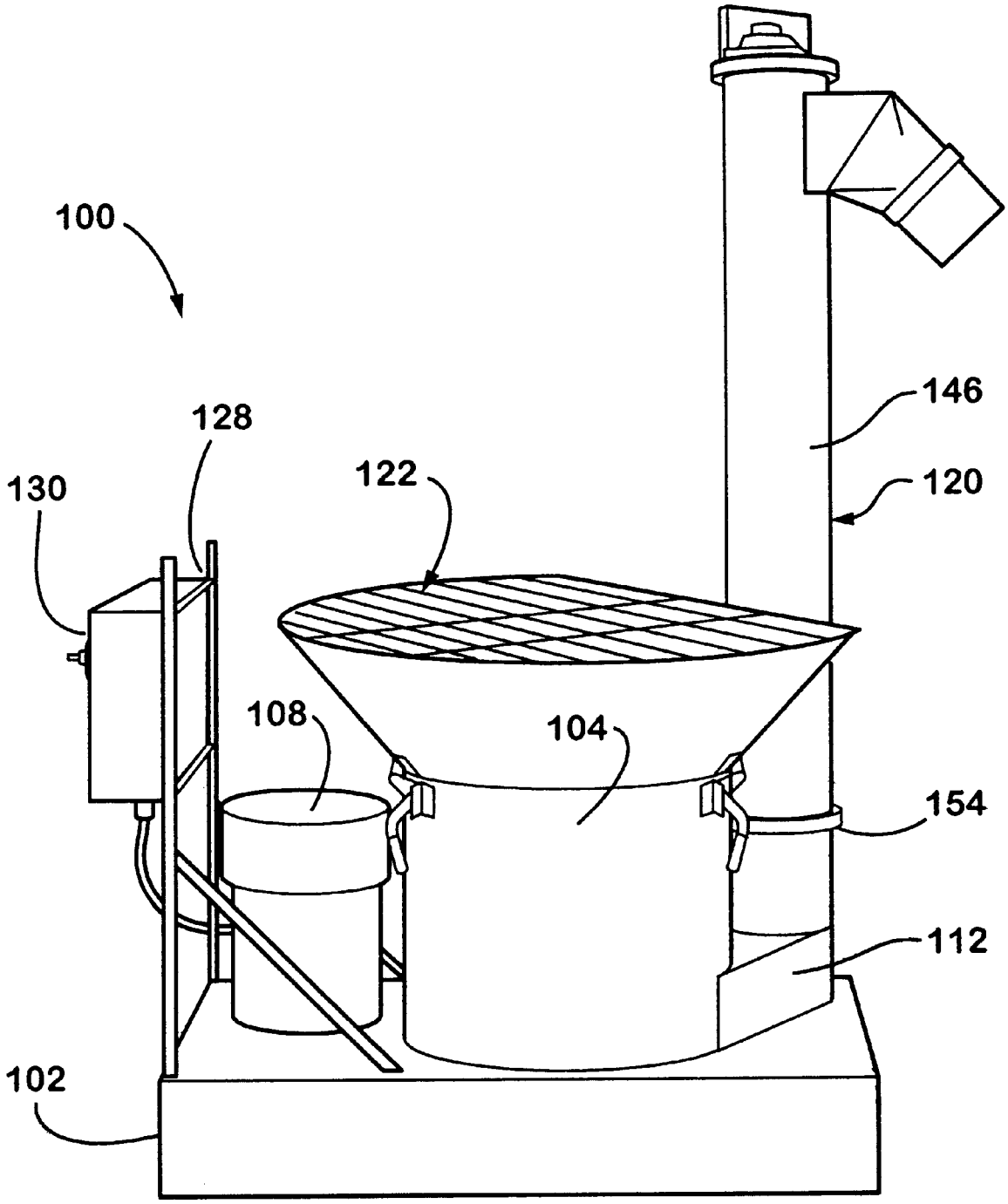
FIG. 1 is a front perspective view of a processor according to the invention.
Figure 2:
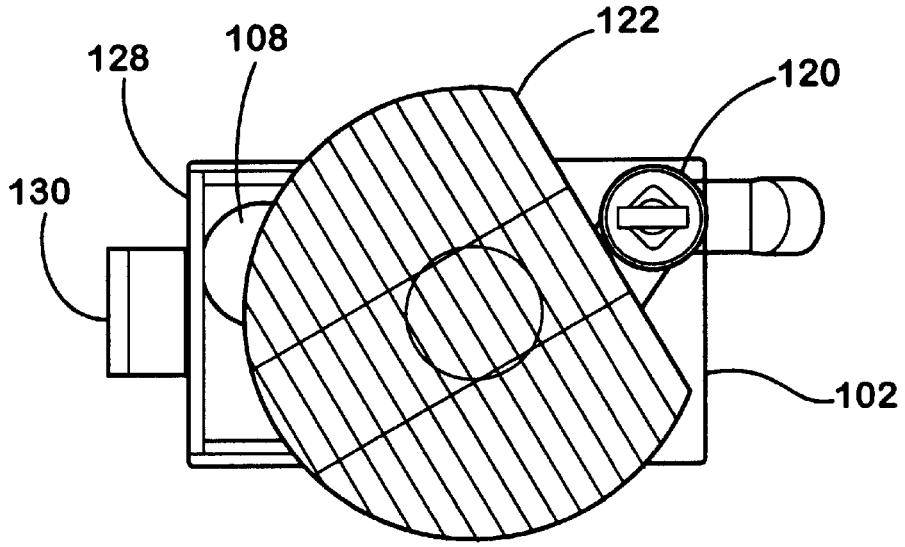
FIG. 2 is a top plan view thereof.
Figure 3:
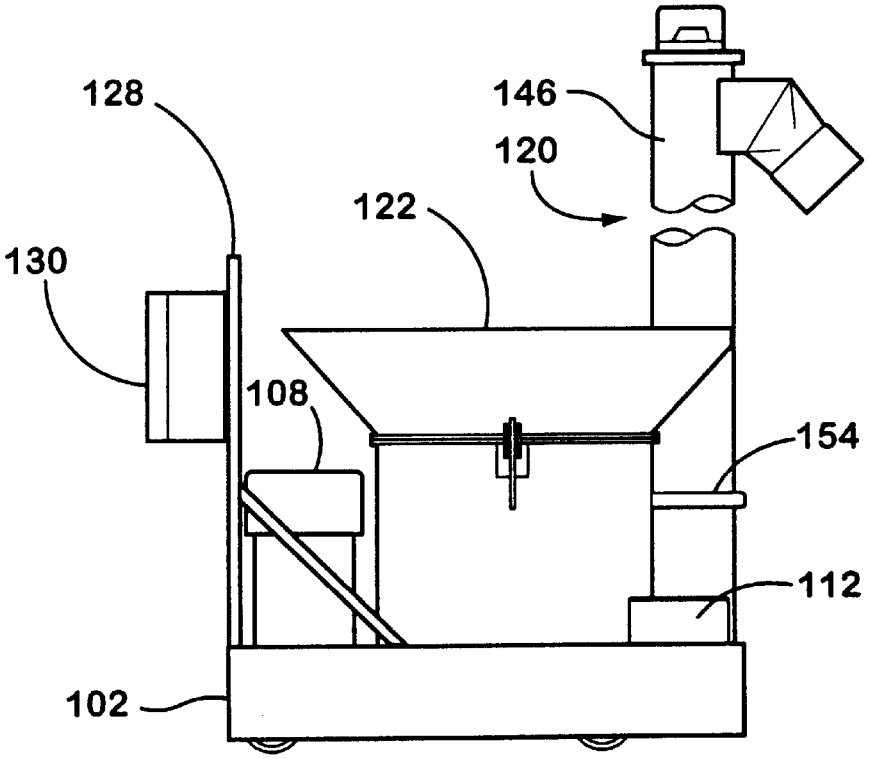
FIG. 3 is a front elevational view thereof.
Figure 5:
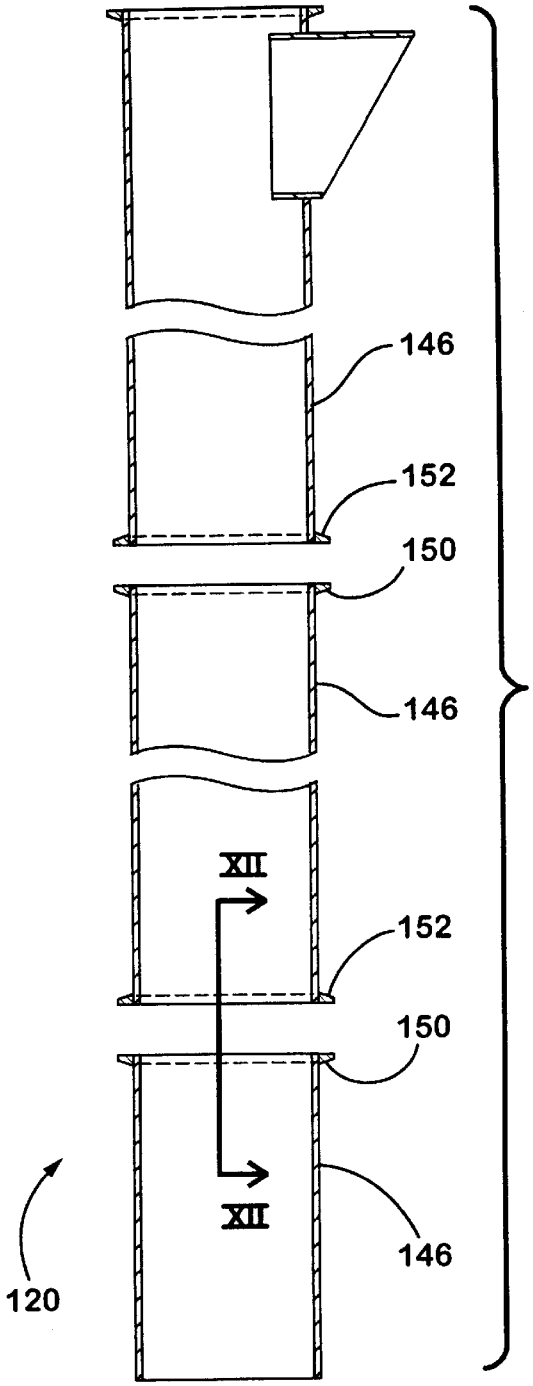
FIG. 5 is an exploded, side elevational view of the spiral elevator thereof.
Figure 6:
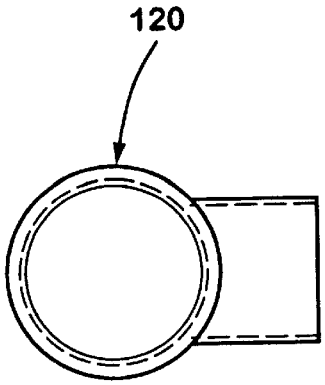
FIG. 6 is a top plan view thereof.
Figure 4:
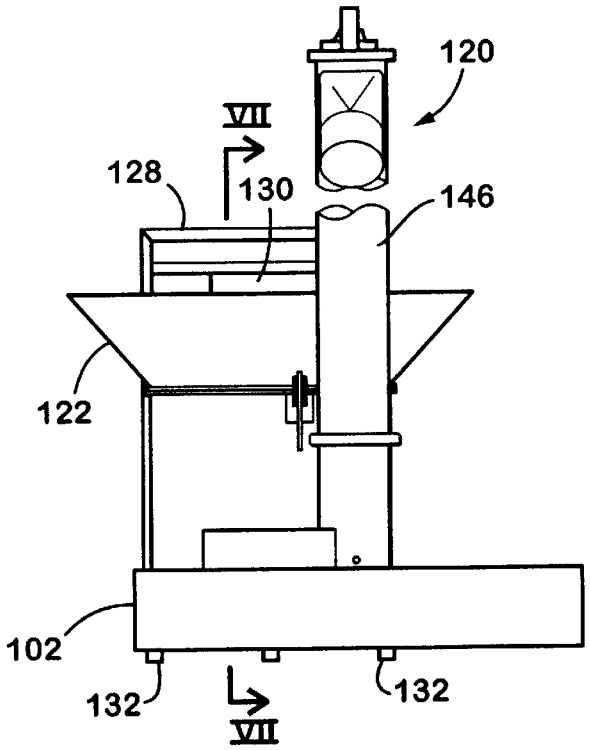
FIG. 4 is a right side elevational view thereof.
Figure 7:
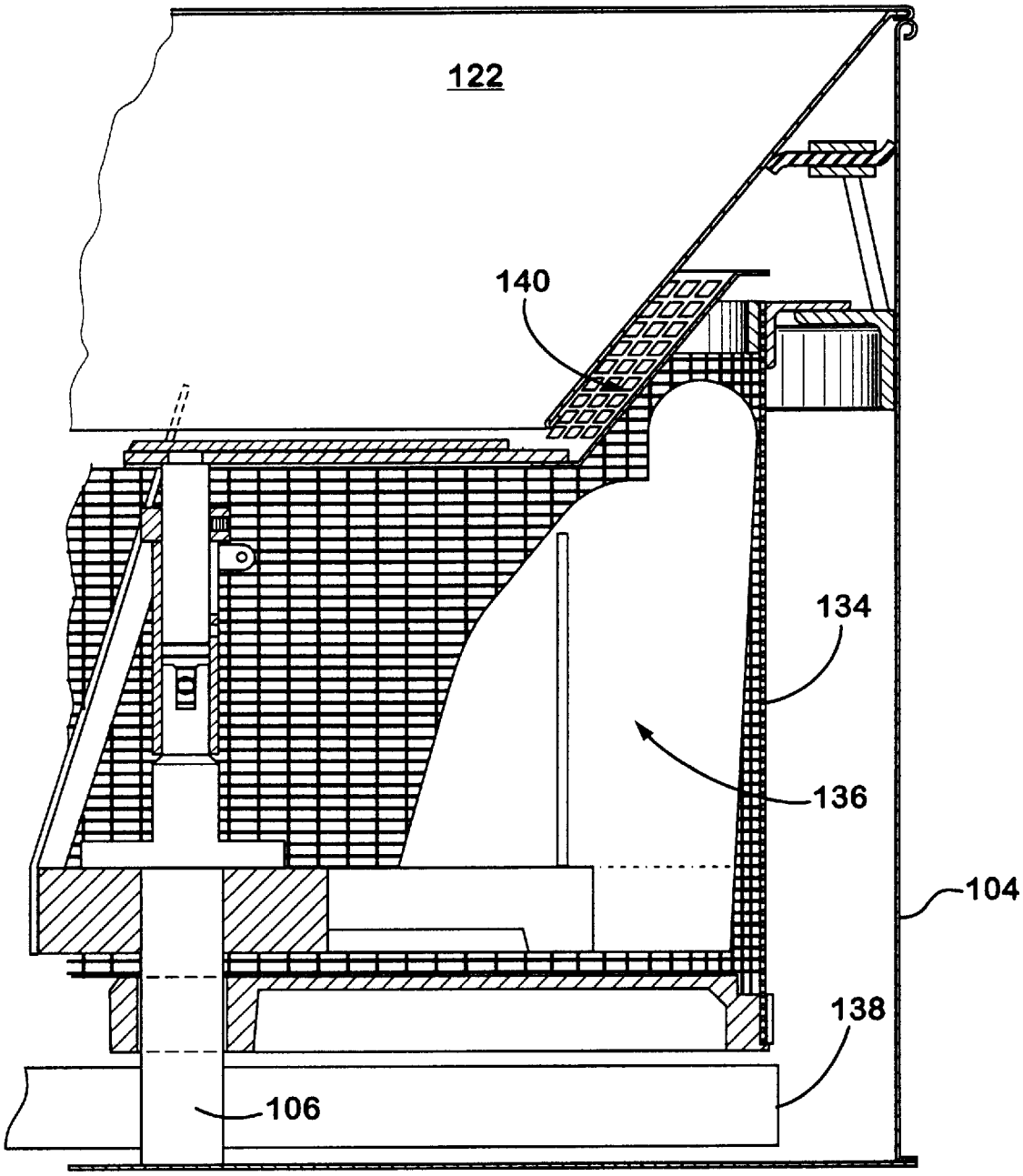
FIG. 7 is a fragmentary cross-sectional view along section line VII—VII of FIG. 4.
Figure 8:
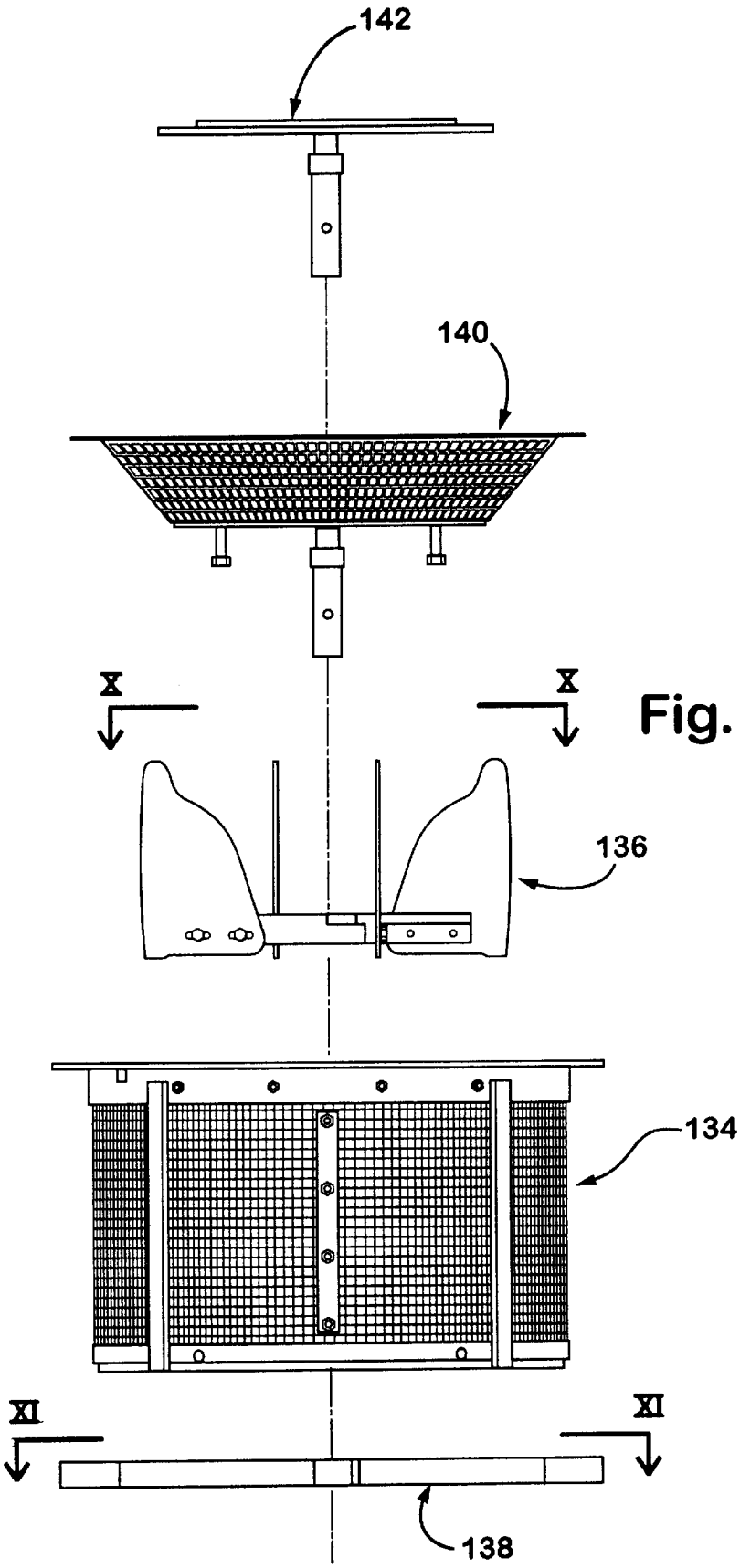
FIG. 8 is an exploded view of the internal assembly of the processor.
Figure 9:
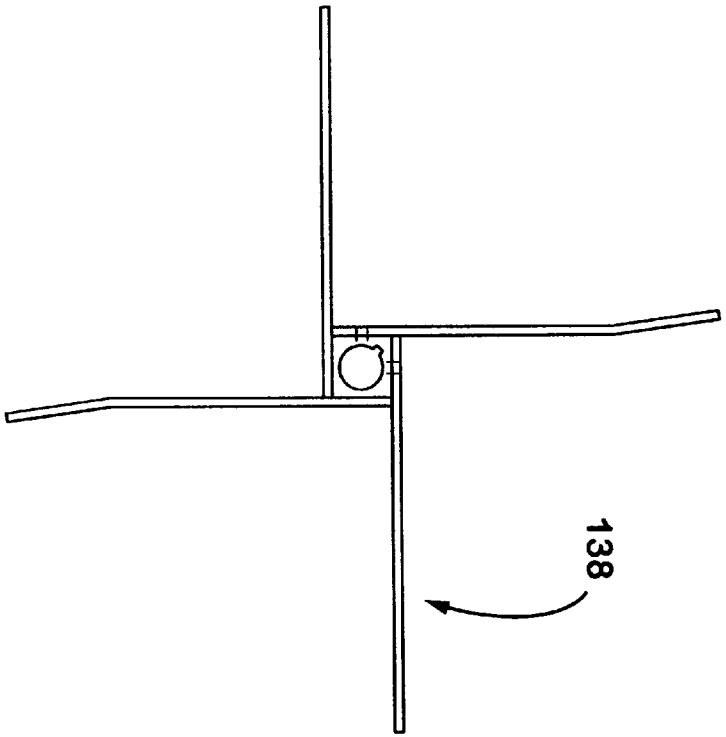
FIG. 9 is a top plan view along sight line IX—IX of FIG. 8.
Figure 10:
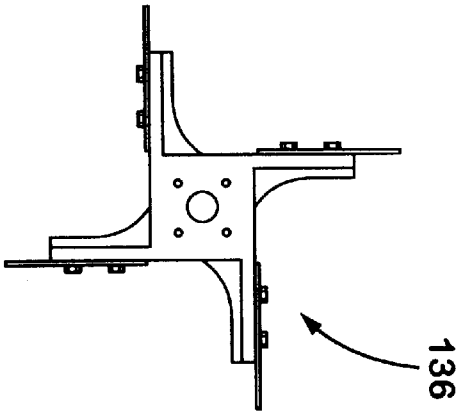
FIG. 10 is a top plan view along sight line X—X of FIG. 8.
Figure 11:
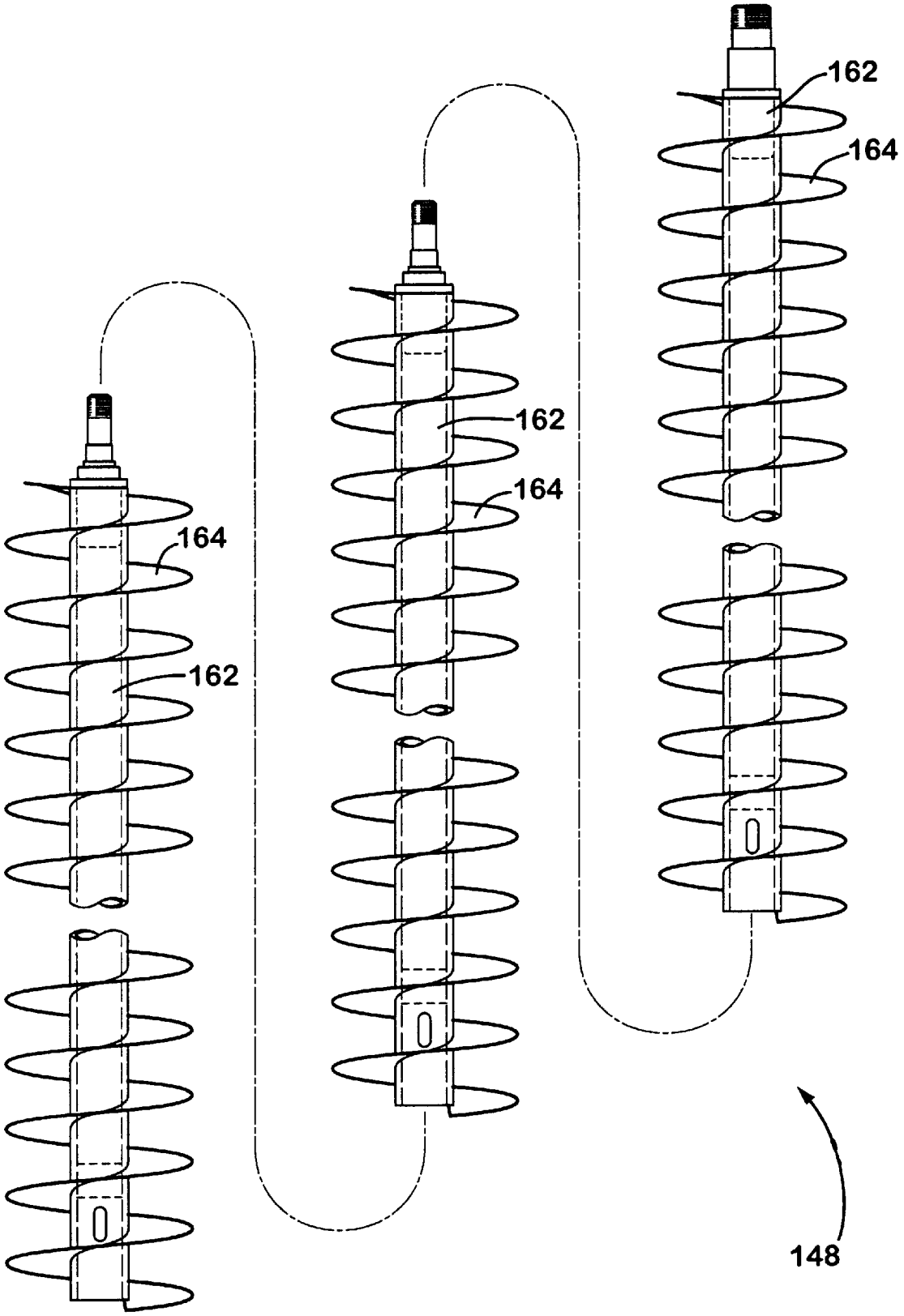
FIG. 11 shows assembly of three elevator spiral sections.

A material processor, mixer, or sieve according to the invention is generally shown in the drawing figures and identified by the reference numeral 100. The material processor 100 is suitable for a broad range of material mixing requirements, either wet or dry, including commercial baking mixing of food ingredients, and mixing of chemicals in production of plastic products, for example. Processor 100 has a base or frame 102 with an enclosure or tub 104 mounted on the frame. A drive spindle 106 is located in the tub 104 and a drive in the form of a motor 108, for example, is connected to drive the spindle 106. A centrifugal sieve, including a sieve basket 134 and sieve impeller 136, discussed further below, is removably located in the tub 104 and a discharge chute 112 directs material from the tub to a conveyor or elevator 120.

Any suitable structural materials may be used in the fabrication of the material processor 100 and its components. Such materials will typically include metals and plastics, for example. The specific materials used will depend upon a number of factors, including, but not limited to, the characteristics of the material being processed and the acceptable useful life of the material processor or component thereof, which results from the material chosen, as will be understood by one having ordinary skill in the art. The use of stainless steel to fabricate the material processor and its components has proven successful as a durable, sanitary, and stable material for many commercial material processing operations.

The frame 102 preferably has a box base with a length of about 36 to about 42 inches (914 mm to 1067 mm), a width of about 22 to about 26 inches (558 mm to 660 mm), and a height of about 7 inches (178 mm) for general commercial applications. The tub 104 is a tubular member that is generally centered in the width of the base, is about 15 to about 20 inches (381 mm to 508 mm) tall, has an about 20 to about 24 inches (508 mm to 610 mm) inside diameter, and is formed of stainless steel. A loading hopper 122 is positioned on top of the tub 104 to provide an ingress to receive material into the tube 104. The hopper is conveniently configured generally as a conic frustum. As is specifically shown in the drawing figures, the loading hopper 122 may have a flattened side to provide clearance for the conveyor or elevator 120.

The drive spindle 106 is generally centered in the tub 104 and is connected to operate the centrifugal sieve, described further below. The drive motor 108 is mounted to the frame and connected by pulleys and a drive belt, for example, or by other suitable power transmission arrangement, to the drive spindle 106, as will be understood by one having ordinary skill in the art.

Figure 16:
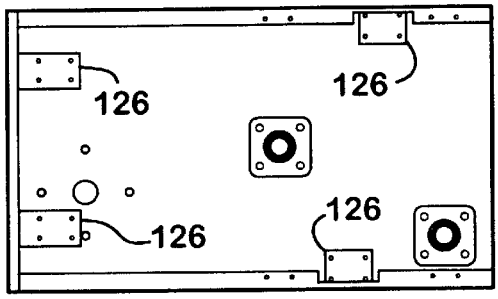
FIG. 16 is a bottom plan view thereof.
Figure 15:
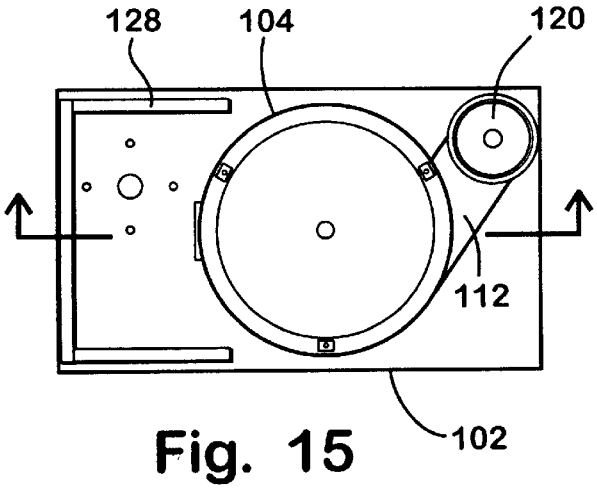
FIG. 15 is the view of FIG. 2 with the loading hopper and spiral elevator extensions removed.
Figure 17:
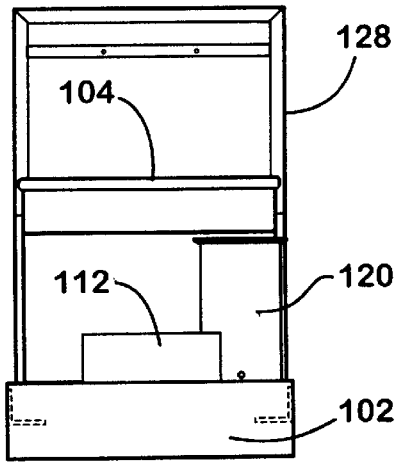
FIG. 17 is a right hand elevational view thereof.
Figure 19:
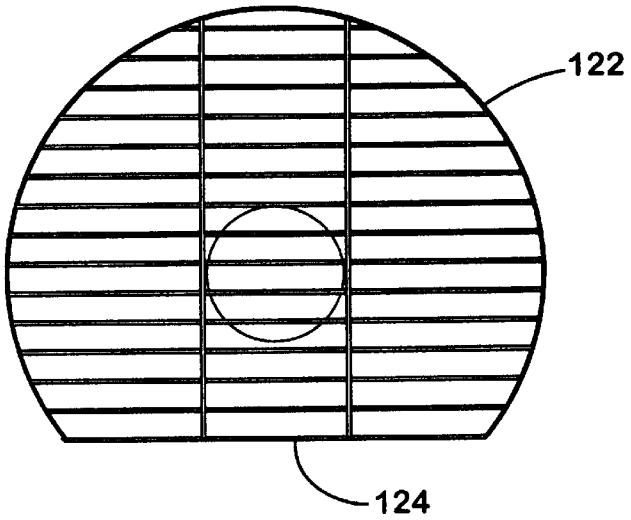
FIG. 19 is top plan view thereof.
Figure 20:
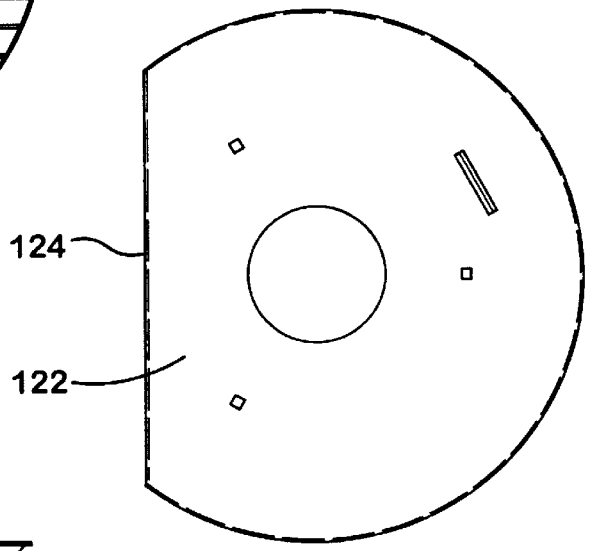
FIG. 20 is a bottom plan view thereof.
Figure 18:
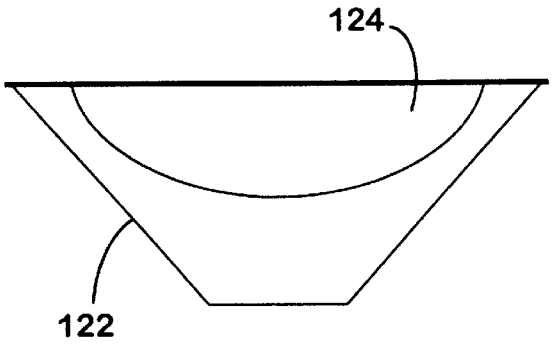
FIG. 18 is a side elevational view of the loading hopper.
Figure 21:
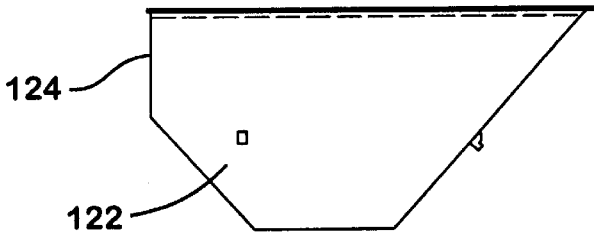
FIG. 21 is another side elevational view thereof.
Figure 22:
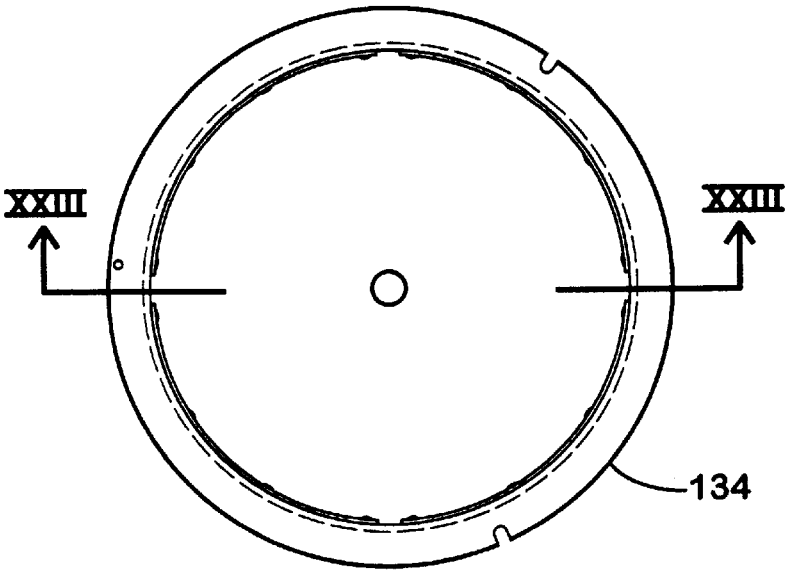
FIG. 22 is a top plan view of the sieve basket.
Figure 23:
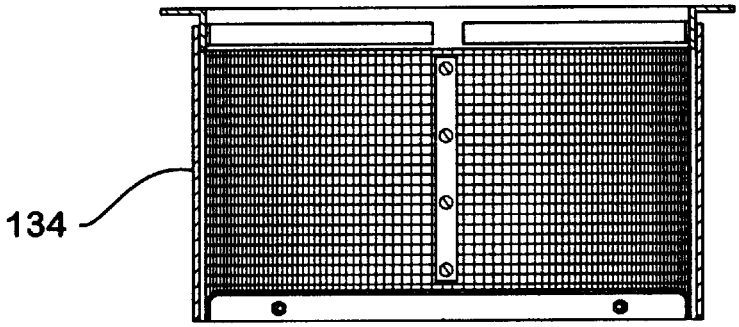
FIG. 23 is a cross-sectional view thereof, taken along section line A—A of FIG. 22.
Figure 24:
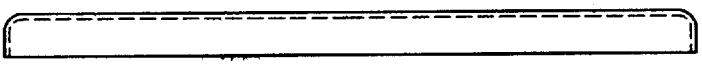
FIG. 24 is a side elevational view of the sieve basket bottom panel.
Figure 25:
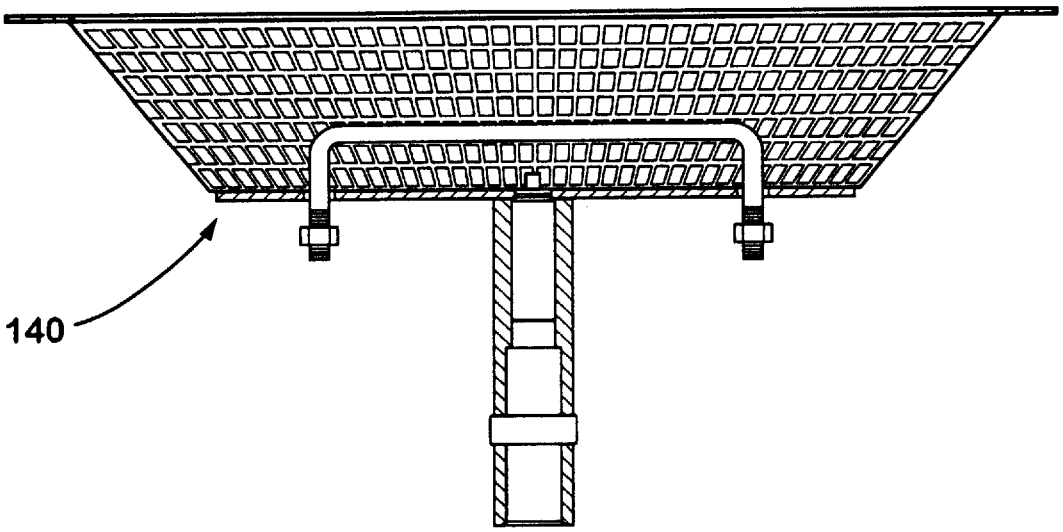
FIG. 25 is a diametrical cross-sectional view of a tailing feed unit for the material processor.
Figure 26A:
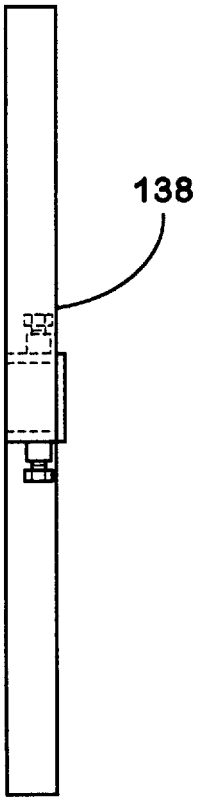
FIG. 26 shows a side elevational view and a top plan view of a lower impeller of the material processor.
Figure 26B:
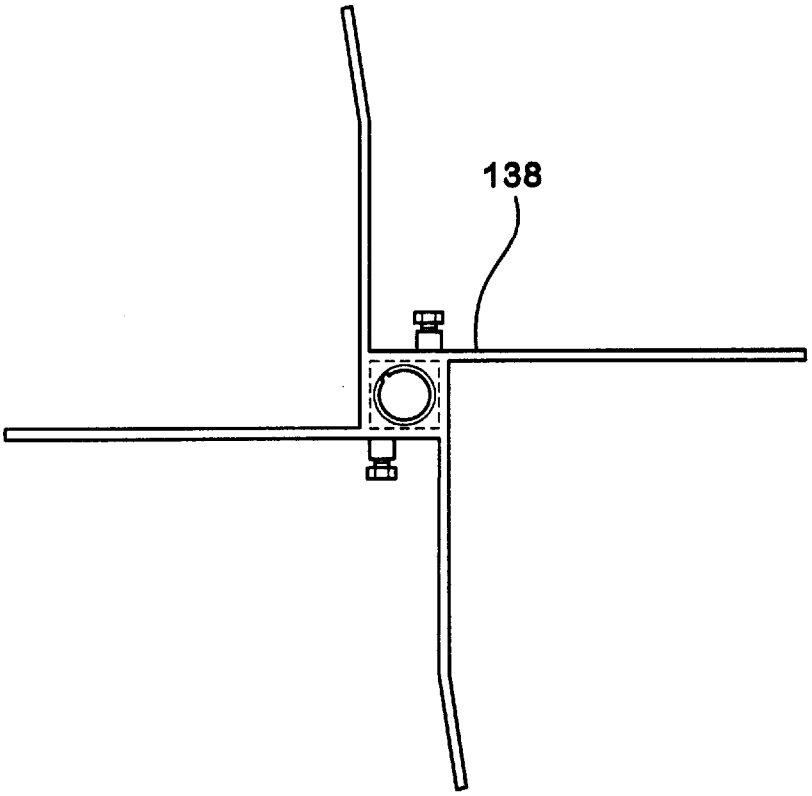
Figure 27A:
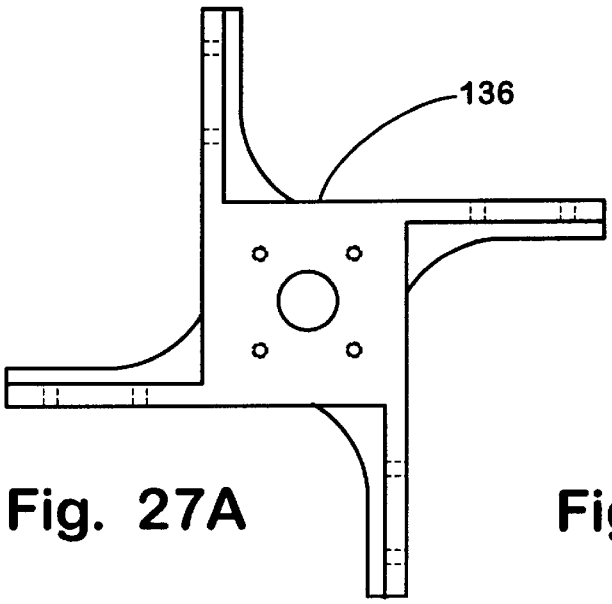
FIG. 27 shows a top plan view and a side elevational view of the hub of the sieve impeller.
Figure 27B:
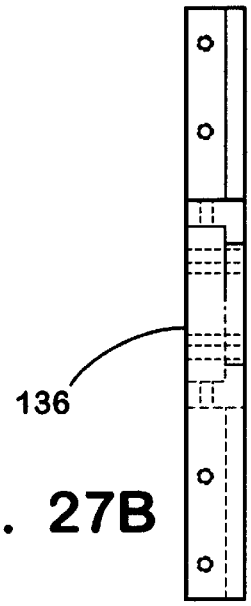
Figure 28A:
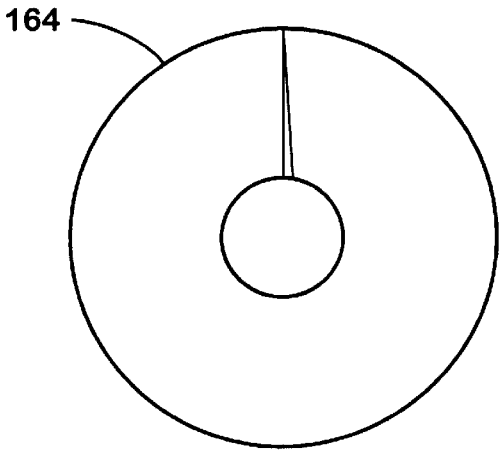
FIG. 28 shows a plan view and an edge view of an elevator spiral blade.
Figure 28B:
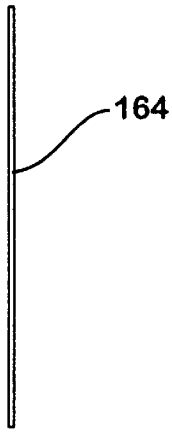
Figure 29A:
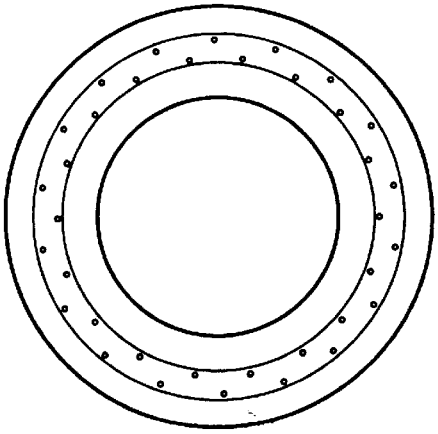
FIG. 29 shows a plan view and an edge view of the donut seal of the material processor.
Figure 29B:
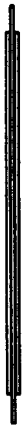

The material processor 100 may be stationary, or may be provided with casters to transport the processor from one use location to another. Thus, the base or frame 102 may be provided with caster pads 126 (FIG. 16). The base 102 may also be provided with a handle 128 (FIGS. 3, 14, 15 and 17) for a user to push the processor 100 on the casters. The handle 128 also provides a convenient support frame for an electrical control box 130 to control operation of the processor.

The centrifugal sieve assembly includes a stationary sieve basket 134 and rotary sieve impeller 136. A lower, discharge impeller 138 is provided below the sieve basket 134. The discharge impeller 138, sieve basket 134, and sieve impeller 136 are concentrically mounted in the tub 104, with the discharge impeller 138 and sieve impeller 136 being connected with the drive spindle 106 and the drive spindle passing through the bottom of the sieve basket. Depending upon the specific material processing utilized, an optional tailing feed unit 140 or deflector plate 142 may be stacked above the sieve impeller 136 on the drive spindle 106.

The discharge chute 112 (FIG. 15) extends from the tub enclosure 104 to the spiral elevator 120 to remove material from the enclosure to the elevator. The processed material moves from the sieve basket 134 to the discharge impeller 138, which sweeps the material out through the discharge chute 112 to the elevator 120.

The spiral elevator 120 is a modular material conveyor comprising a series of pipe sections 146 and matching spiral sections 148. Thus, the elevator 120 may be configured, and reconfigured, to a length, or height, that best suits the user's immediate needs. The pipe sections 146 are generally cylindrical lengths of tube that have a diameter, two opposing ends, and an axis extending through the two ends. Both the pipe sections 146 and matching spiral sections 148 are most preferably about 4 to about 8 inches (101 mm to 203 mm) in diameter and constructed of stainless steel. The spiral sections 148 have a spiral shaft 162 extending along the axis, and a helical blade 164 extending along the shaft 162. The helical blade 164 extends generally radially outward from the shaft 162 and the axis. The shaft 162 will be configured with various lengths and diameters, according to the selected diameter of the pipe sections 146 and matching spiral sections 148, as will be understood and appreciated by one having ordinary skill in the art.

Adjacent pipe sections 146 are mated with cooperating male 150 and female 152 flange ends and an overlaying, sanitary quick clamp ring 154 that cams two sections 146 together as the ring 154 is tightened around adjoining male 150 and female 152 flanges. When mated together, the cooperating male 150 and female 152 flanges define a generally truncated V-shaped ridge that extends outward from the outer surface of the pipe sections 146, with opposing inclined surfaces. The clamp ring 154 overlays and presses inward upon the inclined surfaces, camming the male 150 and female 152 flanges toward one another.

Figure 12:
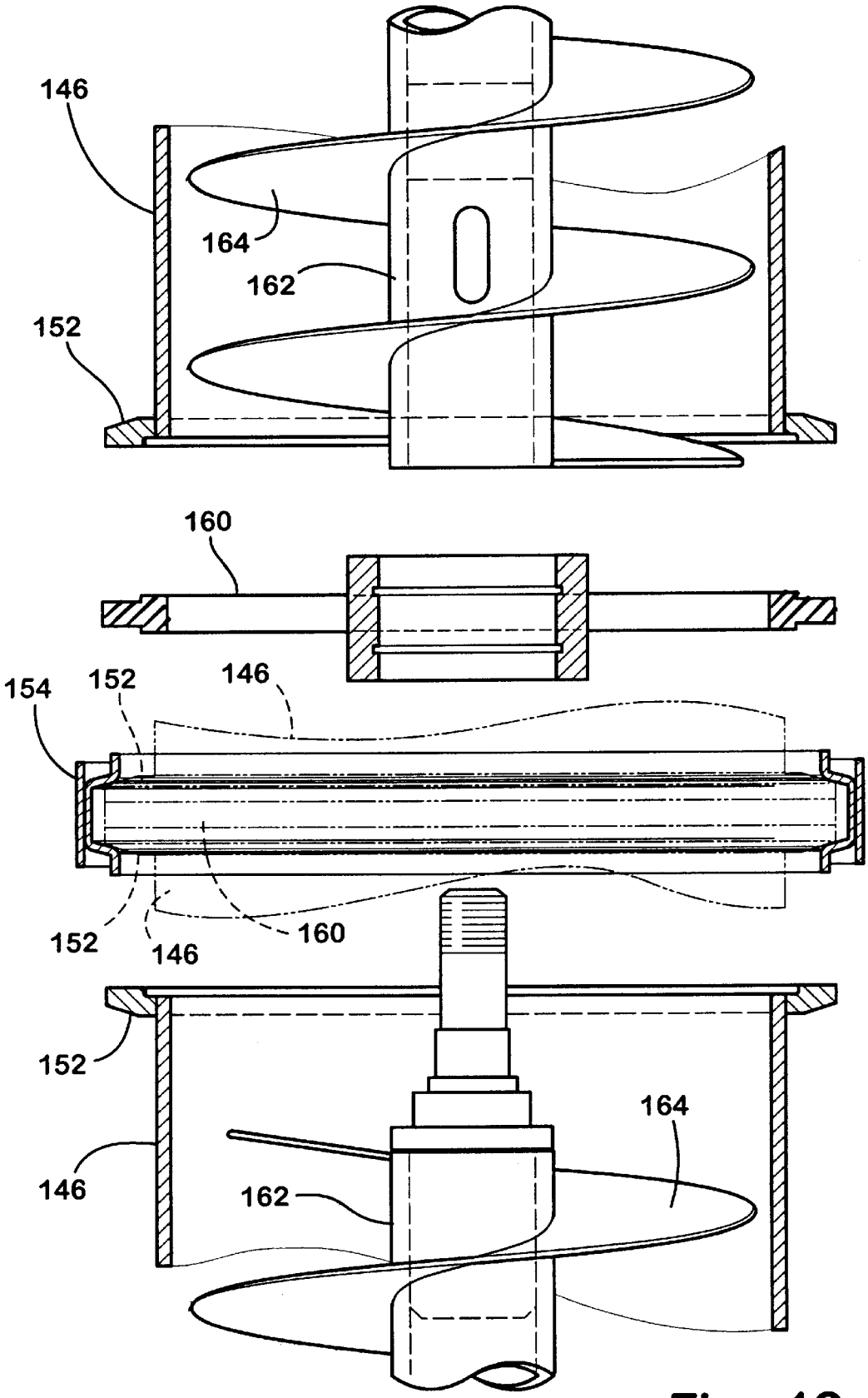
FIG. 12 is an exploded, fragmentary, cross-sectional view along section line XII—XII of FIG. 5.
Figure 13:
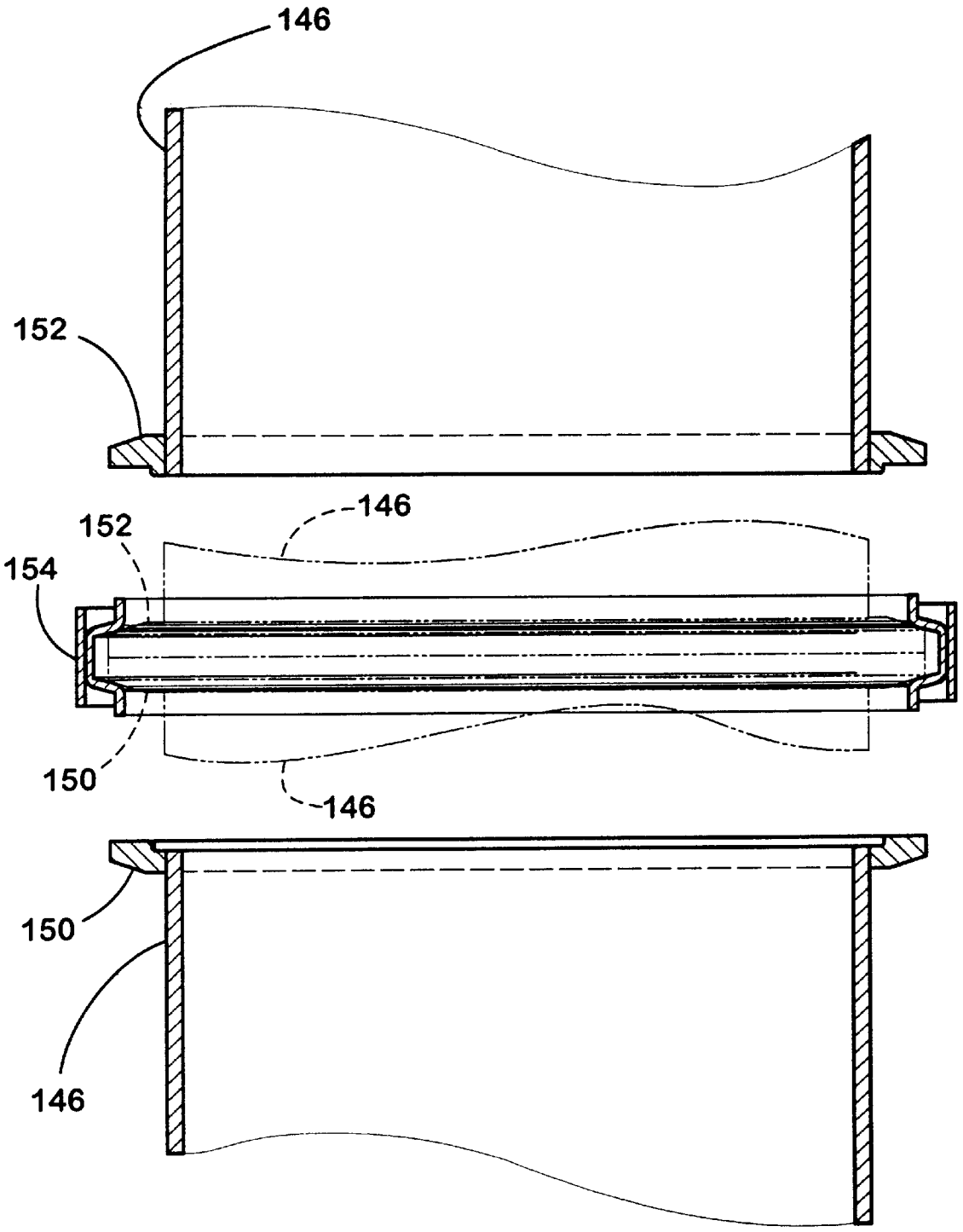
FIG. 13 is the view of FIG. 12, in an alternative, shorter, configuration wherein the bearing journal is not used, and not showing the spiral sections.
Figure 14:
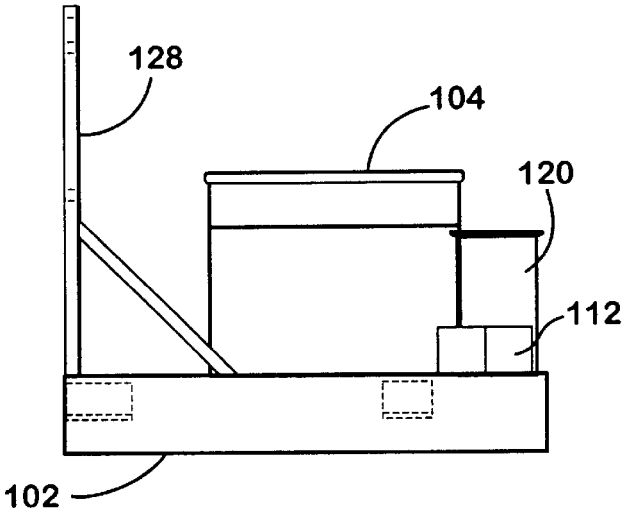
FIG. 14 is a cross-sectional view along section line VII–VII of FIG. 15.

Depending upon the length of the assembled spiral elevator 120, an intermediate or steady bearing may need to be interposed in the spiral (FIG. 12), as will be understood by one having ordinary skill in the art. The steady bearing is preferably provided every about 36 to about 72 inches (914 mm to 1829 mm) of spiral length. The steady bearing is held in a bearing support 160 that is sandwiched between cooperating, adjacent female ends 152 of adjoining elevator spiral tube sections 146.

According to common knowledge, conventional auger conveyors are known to be successfully used only when operated in a "full pack", high density, high power, low rpm condition, as will be understood by one having ordinary skill in the art. Common knowledge further dictates that for an about 4 to about 8 inch (101 mm to 203 mm) diameter auger, the pitch of the auger blade must be at least one half the diameter for successful, efficient auger transport. Contrary to this conventional wisdom, the spiral conveyor 120 of the invention is a low density, low power, high speed elevator that conveys or transports product in a fluidized state, rather than in the conventional solid state of conventional auger conveyors. More particularly, the spiral 148 and the helical blade 164 are most preferably rotated at a speed in the range of about 800 to about 1,200 rpm. While the spiral rotational speed range may vary somewhat more and less than the range just stated, this is an optimal speed range that has been found to consistently attain fluidized transportation of the material being handled, with good result. The spiral rotational speed is important and depends upon various factors, such as the material formulation, density, granulation, and viscosity, for example.

The helical blade pitch is set at less than about one half the diameter of the spiral for the about 4 to about 8 inch (101 mm to 203 mm) diameter spiral 148. With unacceptably low pitch and high rotational speed by conventional standards, the elevator 120 of the invention operates in a "fluidized" or "pneumatic pumping mode", rather than the screw action mode of traditional auger conveyors that operate in a choke feed, non-emptying mode. Further, the spiral 148 of the invention operates with a volumetric material transfer density in the range of about 12 to about 15 percent, rather than the conventional auger conveyer preference to achieve a volumetric material transfer density approaching 100 percent.

The relatively high rotational speed of the spiral 148 and helical blade 164, sets up a centrifugal action that pushes the material outward from the spiral shaft 162, toward the elevator tubing, to create a "sealing" action at the tip of the spiral blade 164. Thus, material is transported through the spiral elevator conveyor 120 generally on the tip of the spiral blade 164.

It will be understood by those who practice the invention and by one having ordinary skill in the art, that various modifications and improvements to the embodiments discussed above, may be made without departing from the spirit of the disclosed concept. The scope of protection afforded is to be determined by the claims and by the breadth of interpretation allowed by law.

We claim:

1. A material processor comprising:

an enclosure having an ingress to receive material into the enclosure, and a discharge to remove material from the enclosure;

a spindle located in the enclosure, the spindle having a longitudinal spindle axis and being rotatable about the spindle axis;

a drive operatively connected with the spindle to rotate the spindle about the spindle axis;

a sieve located in the enclosure and coupled with the spindle, the ingress feeding material into the sieve; and a conveyer operatively connected with the discharge to transfer material, the conveyor having a generally cylindrical tube with a tube diameter, with two opposing ends, and with an axis extending through the ends, and having a helical blade extending along the axis between the two ends, the helical blade being rotatable about the axis and being rotated at high speed, the blade further having a series of blade tips spaced along the axis, and wherein the space between adjacent blade tips is less than or equal to about one half of the tube diameter, the tube further including first and second tube sections that are coupled together with a clamp ring, the first section having a male end with a male flange, the second section having a female end with a corresponding female flange, the male and female ends and flanges abutting one another to define a generally truncated V-shaped ridge that extends outward from the tube with opposing inclined surfaces, the clamp ring overlaying and pressing inward upon the inclined surfaces to press the male and female flanges and ends together.

2. A material processor comprising:

an enclosure having an ingress to receive material into the enclosure, and a discharge to remove material from the enclosure;

a spindle located in the enclosure, the spindle having a longitudinal spindle axis and being rotatable about the spindle axis;

a drive operatively connected with the spindle to rotate the spindle about the spindle axis;

a sieve located in the enclosure and coupled with the spindle, the ingress feeding material into the sieve; and a conveyer operatively connected with the discharge to transfer material, the conveyor having a generally cylindrical tube with a tube diameter, with two opposing ends, and with an axis extending through the ends, and having a helical blade extending along the axis between the two ends, the helical blade being rotatable about the axis; the tube further including first and second tube sections that are coupled together with a clamp ring, the first section having a male end with a male flange, the second section having a female end with a corresponding female flange, the male and female ends and flanges abutting one another to define a generally truncated V-shaped ridge that extends outward from the tube with opposing inclined surfaces, the clamp ring overlaying and pressing inward upon the inclined surfaces to press the male and female flanges and ends together.

3. In a material processor that has an enclosure, a sieve, and a discharge operatively connected with the sieve to transfer material from the sieve, a conveyer operatively connected with the discharge, the conveyer comprising:

a generally cylindrical tube that has a diameter, two opposing ends, and an axis extending through the two ends, the tube further including first and second tube sections that are coupled together with a clamp ring, the first section having a male end with a male flange, the second section having a female end with a corresponding female flange, the male and female ends and flanges abutting one another to define a generally truncated V-shaped ridge that extends outward from the tube with opposing inclined surfaces, the clamp ring overlaying and pressing inward upon the inclined surfaces ridge to press the male and female flanges and ends together;

a corresponding helical blade in the tube, the blade extending along the axis between the two ends, extending generally radially outward from the axis, being rotatable about the axis, being rotated at high speed, and having a series of blade tips spaced along the axis, the space between adjacent blade tips being less than or equal to about one half of the tube diameter.

4. In a material processor that has an enclosure, a sieve, and a discharge operatively connected with the sieve to transfer material from the sieve, a conveyer operatively connected with the discharge, the conveyer comprising:

a generally cylindrical tube that has a diameter, two opposing ends, and an axis extending through the two ends the tube further including first and second tube sections that are coupled together with a clamp ring, the first section having a male end with a male flange, the second section having a female end with a corresponding female flange, the male and female ends and flanges abutting one another to define a generally truncated V-shaped ridge that extends outward from the tube with opposing inclined surfaces, the clamp ring overlaying and pressing inward upon the inclined surfaces ridge to press the male and female flanges and ends together;

a corresponding helical blade in the tube, the blade extending along the axis between the two ends, extending generally radially outward from the axis, and being rotatable about the axis.

* * * * *